US008402582B2

(12) United States Patent
Xia et al.

(10) Patent No.: US 8,402,582 B2
(45) Date of Patent: Mar. 26, 2013

(54) AIR MATTRESS

(75) Inventors: Yonghui Xia, Zhejiang (CN); Jigui Xia, Zhejiang (CN); Jinglong Cao, Zhejiang (CN)

(73) Assignee: Zhejiang Natural Travel Goods Co., Ltd. (CN)

( * ) Notice: Subject to any disclaimer, the term of this patent is extended or adjusted under 35 U.S.C. 154(b) by 15 days.

(21) Appl. No.: 13/158,731

(22) Filed: Jun. 13, 2011

(65) Prior Publication Data

US 2012/0000017 A1 Jan. 5, 2012

(30) Foreign Application Priority Data

Jun. 30, 2010 (CN) ..... 2010 1 0216170
Jun. 30, 2010 (CN) ..... 2010 2 0250389 U

(51) Int. Cl.
*A47C 27/08* (2006.01)

(52) U.S. Cl. ..... 5/712; 5/706; 5/682

(58) Field of Classification Search ..... 5/682, 706, 5/711, 712
See application file for complete search history.

(56) References Cited

U.S. PATENT DOCUMENTS 1,335,961 A * 4/1920 Garner ..... 5/712
1,706,560 A * 3/1929 Carlson ..... 5/712
1,970,502 A * 8/1934 Hamza ..... 5/712
2,016,054 A * 10/1935 Sentell ..... 5/712
2,604,641 A * 7/1952 Reed ..... 5/710
2,887,692 A * 5/1959 Gosman ..... 5/655.3
3,790,975 A * 2/1974 Philipp et al. ..... 5/711
4,826,715 A * 5/1989 Lee ..... 428/64.1
7,191,481 B2 * 3/2007 Hsu et al. ..... 5/712
7,234,184 B2 * 6/2007 Yang ..... 5/712
7,694,372 B1 * 4/2010 Boyd ..... 5/712

FOREIGN PATENT DOCUMENTS

DE 299 11 479 10/1999
DE 200 23 510 9/2004
EP 1 021 976 7/2000

OTHER PUBLICATIONS

German Office Action for Application No. 10 2011 106 166.9 mailed Oct. 11, 2012 (6 pages).

* cited by examiner

*Primary Examiner* — Michael Trettel
(74) *Attorney, Agent, or Firm* — Harness, Dickey & Pierce, P.L.C.

(57) ABSTRACT

An air mattress is provided. The air mattress may comprises: a top sheet and a bottom sheet, the top and bottom sheets being made of a flexible airtight material and being connected to form an airtight inflatable compartment; and at least one vertical connecting unit, being disposed within the compartment, wherein the vertical connecting units are attached to respective inner surfaces of the top and bottom sheets to form connecting areas. The air mattress may also comprise a side sheet and at least one horizontal connecting unit.

13 Claims, 10 Drawing Sheets

AIR MATTRESS

CROSS-REFERENCE TO RELATED APPLICATIONS

This application claims benefit of and priority to Chinese Patent Application for Invention No. 201010216170.5, filed on 30 Jun. 2010, and Chinese Patent Application for Utility Model No. 201020250389.2, filed on 30 Jun. 2010, both of which are incorporated herein by reference in their entirety.

BACKGROUND OF THE INVENTION

1) Field of the Invention

The present invention relates generally to an air mattress. More particularly, the present invention relates to an improved air mattress that is more comfortable and has a less weight.

2) Description of Related Art

Air mattresses are used outdoors, at home, in the field of medical care, and so on, owing to their portability and easy storage. A conventional air mattress, as shown in FIG. 1, comprises a top sheet 101, a bottom sheet 102, annular connecting bands 103, and a side sheet 104. The top sheet 101, the bottom sheet 102, and the side sheet 104 are made of a flexible airtight material, for example, polyvinyl chloride (PVC), and these sheets are welded together to form an inflatable compartment. The annular connecting band 103 is disposed within the inflatable compartment, with its top and bottom welded to the top sheet 101 and the bottom sheet 102 respectively. When the air mattress is inflated, the annular connecting bands 103 restrain the top and bottom sheets 101 and 102 to such an extent that the inflatable compartment looks and feels like a bed. As shown in FIG. 2, the annular connecting band 103 is formed by connecting a flat connecting band end to end to form a ring containing a hole in its center. Therefore, the resulting connecting band is named an annular connecting band. As shown in FIG. 3, the annular connecting band 103 is welded to the top and bottom sheets 101 and 102 to form a welded joint 105. The welded joint 105 may be circular, elliptic, oval, hexagonal, octagonal, and so on. Alternatively, the annular connecting band may be substituted by an I-shaped connecting band. As shown in FIG. 4, I-shaped connecting bands 103' are welded to the top and bottom sheets 101 and 102 to form linear welded joints 105'.

However, the known air mattress is made of three sheets of material, i.e. the top sheet, the bottom sheet, and the side sheet. Therefore, there are more welded joints between these three sheets, which requires more welding steps and takes more time. Further, when the inflated compartment is filled with air, under the action of the connecting bands, obvious projections and depressions are created on the surface of the air mattress, the depressions being positioned at the welded joints of the top sheet and the annular connecting bands, and the curved projections being positioned in the areas between the welded joints. As a result, the contact area between the surface of the air mattress and the human body is relatively small. With the I-shaped connecting bands, there also exist rectangular projections on the surface. This leads to poor flatness of the surface, and in use, the air mattress feels uncomfortable. In addition, if more connecting bands are provided, the surface will become more rigid and less flexible.

Furthermore, 90 percent of the present commercially available air mattresses are made of pure PVC, flocked PVC, PVC laminated polyester or nylon fabric, and so on. These air mattresses are provided with annular connecting bands, I-shaped connecting bands, or slightly modified variations thereof. The air mattress made of PVC mainly has the following disadvantages: (1) the air mattress of this type is heavy and thus has poor portability; (2) PVC material is easy to be pierced and worn out; (3) PVC material is brittle at a low temperature and thus is not cold resistant; (3) the air mattress is not environmentally friendly; (5) the air mattress has a poor flatness; (6) the material must have a sufficient thickness since high frequency moulding is used in the manufacture process to perform a large-area welding operation; (7) since the air mattress is provided with narrow welding joints and has small areas for receiving pulling forces, the welding joints are often disengaged under the action of pulling forces, thereby leaking gas from the air mattress; and (8) the manufacture process is complex, resulting in high manufacturing cost.

SUMMARY OF THE INVENTION

According to an embodiment of the invention, an air mattress may comprise: a top sheet and a bottom sheet, the top and bottom sheets being made of a flexible airtight material and being hermetically connected to form an airtight inflatable compartment; and at least one vertical connecting unit, being disposed within the compartment, wherein the at least one vertical connecting unit is attached to respective inner surfaces of the top and bottom sheets to form connecting areas.

Each vertical connecting unit comprises: a top connecting member and a bottom connecting member, each of said top and bottom connecting members having a first portion which is attached to the corresponding inner surface and a second portion which is not attached to the inner surface; and an intermediate connecting member, which is connected to the second portions of the top and bottom connecting members.

According to another embodiment of the invention, the air mattress may also comprise: a side sheet hermetically connected to the top and bottom sheets to form the compartment; and at least one horizontal connecting unit disposed within the compartment, said at least one horizontal connecting unit connected to opposite portions of the side sheet so as to restrain the side sheet in the length and width directions of the compartment, wherein each horizontal connecting unit comprises horizontal strips which are attached to the side sheet, and a flexible connecting member, the horizontal strips each having a third portion which is attached to the side sheet and a fourth portion which is not attached to the side sheet, the flexible connecting member connected to the opposite horizontal strips between the corresponding fourth portions thereof.

It is to be understood that both the foregoing general description and the following detailed description are exemplary and explanatory only, and are not restrictive of the invention as claimed.

DETAILED DESCRIPTION OF THE INVENTION

The air mattress of the present invention will be described below by way of example with reference to the drawings. However, it is to be understood that the following embodiments and drawings are illustrative, but not limiting to the scope of the invention. Further, the drawings are not necessarily drawn to scale for purpose of clarity.

Figure 1:
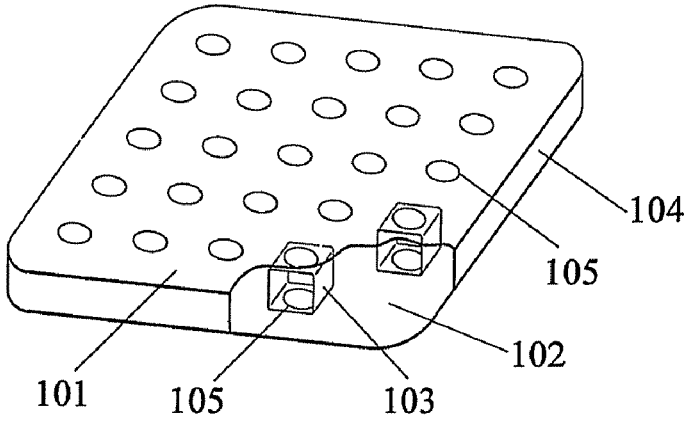
FIG. 1 is a perspective view of an air mattress of the prior art including annular connecting bands.
Figure 2:
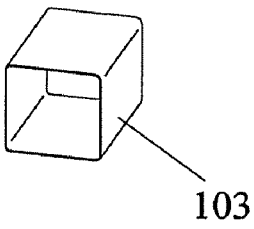
FIG. 2 is a schematic view of the annular connecting band of the air mattress of FIG. 1.
Figure 3:
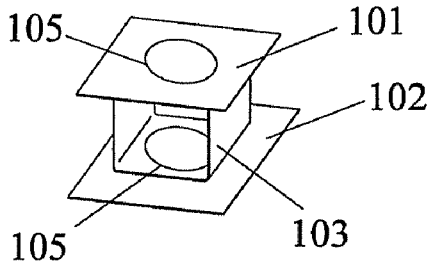
FIG. 3 is a schematic view of a connecting joint formed by the annular connecting band and the top and bottom sheets of the air mattress of FIG. 1.
Figure 4:
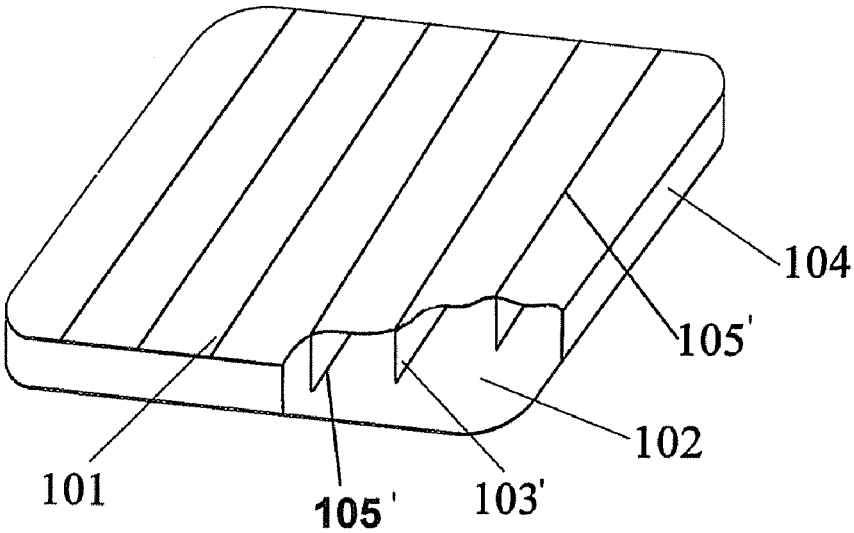
FIG. 4 is a perspective view of an air mattress of the prior art including I-shaped connecting bands.
Figure 5:
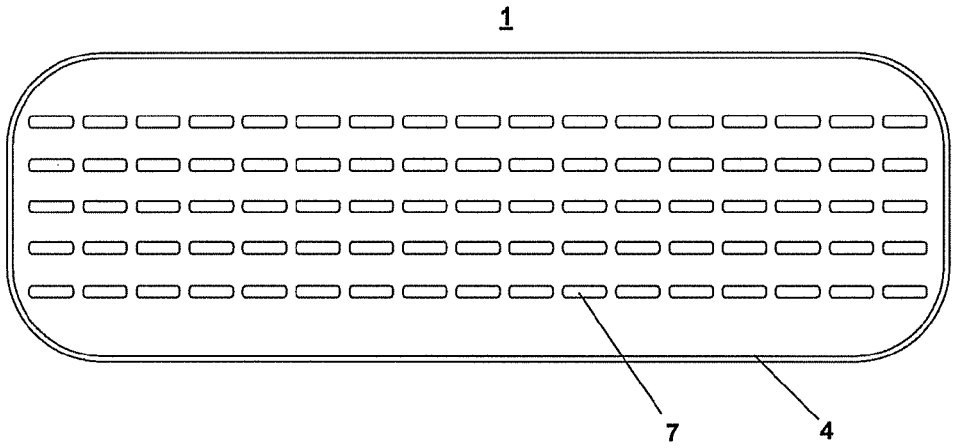
FIG. 5 is a top view of an air mattress of an embodiment according to the present invention.
Figure 6:
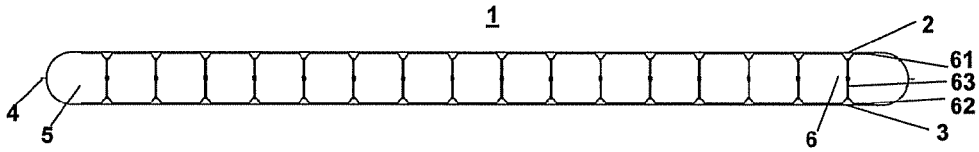
FIG. 6 is a longitudinal sectional view of the air mattress of FIG. 5.
Figure 7:
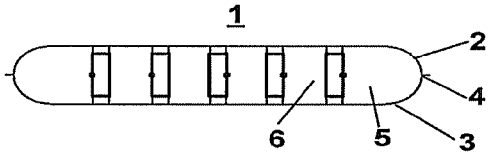
FIG. 7 is a transverse sectional view of the air mattress of FIG. 5.

FIGS. 5-8 show an air mattress 1 of an exemplary embodiment according to the invention. FIG. 5 is a top view of the air mattress 1. FIG. 6 is a longitudinal sectional view of the air mattress of FIG. 5. FIG. 7 is a transverse sectional view of the air mattress of FIG. 5. As shown in FIGS. 6 and 7, the air mattress 1 may include a top sheet 2 and a bottom sheet 3, which are circumferentially connected to form a connecting joint 4, thereby creating an airtight inflatable compartment 5. However, it should be noted that the disclosed air mattress may include a side sheet connected intermediate the top sheet and the bottom sheet. Within the inflatable compartment 5 there is provided a vertical connecting unit 6, which is connected to inner surfaces of the top and bottom sheets 2 and 3, so that connecting areas 7 are formed on outer surfaces of the air mattress, as shown clearly in FIG. 5. The air mattress 1 may also include means for feeding and discharging air (not shown). When the air mattress is being inflated, its vertical connecting unit 6 restricts the top and bottom sheets 1 and 2 in such a manner that the inflatable compartment 5 looks a bed that can support the load in an even manner when a user lies on the air mattress.

The top and bottom sheets 2 and 3 may be made of flexible airtight material, such as PVC, which is used in the prior art. Preferably, the flexible airtight material may comprise TPU (Thermoplastic Urethane) laminated polyester, TPU laminated nylon, TPU laminated with other fabrics, or other macromolecular material laminated fabrics. A TPU film of TPU laminated fabrics may have a thickness of from 0.04 to 0.25 mm. Techniques for connecting the top and bottom sheets are not limited, provided that the inflated compartment is airtight. For example, a high frequency welding process or a thermal welding process may be used.

In one embodiment, the vertical connecting unit 6 comprises several parts. For example, the vertical connecting unit 6 may include a top connecting member 61, a bottom connecting member 62 and an intermediate connecting member 63, as shown in FIG. 6. The top connecting member 61 may include at a first portion which is secured to an inner surface of the top sheet 2, and an adjacent second portion which is not secured to the inner surface of the top sheet 2. Similarly, the bottom connecting member 62 may include a first portion which is secured to an inner surface of the bottom sheet 3, and an adjacent second portion which is not secured to the inner surface of the bottom sheet 3. The intermediate connecting member 63 may be connected to the top and bottom connecting members at the corresponding second portions thereof.

In an example shown in FIG. 7, the top connecting members 61 may comprise a top strip, and the bottom connecting member 62 may comprise a bottom strip. In this example, the top and bottom strips each comprise an elongated band. The air mattress 1 may include a plurality of the top and bottom strips disposed parallel to each other in the longitudinal directions of the air mattress, for example, 5 top strips and 5 bottom strips, as shown in FIG. 5. In other embodiments, each of the top and bottom members may comprise one or more identical or different strips (in terms of size and shape). The top and bottom strips may be made of flexible material which is used in the prior art. Preferably, the top and bottom strips may be made of TPU laminated nylon. The connecting area 7 formed by the first portion of the top strip and the top sheet is generally rectangular, as shown in FIG. 5. The connecting areas 7 may also be rhombic, elliptic, oval, hexagonal, octagonal, and so on. The second portion of the strip may be a narrowed portion of the strip, and extends between the adjacent first portions with a smooth transition. Techniques for connecting the top and bottom strips to the inner surfaces of the top and bottom sheets are not limited. For example, a high frequency welding process or a thermal welding process may be used. The arrangement of the strips is not limited to be in the longitudinal direction as shown, and may be in the traverse direction, in the diagonal direction, or in any other direction.

The intermediate connecting member 63 is flexible, preferably a rope. As shown in FIGS. 6 and 7, two corresponding second portions of the top and bottom connecting members may be connected to each other by a single rope. The rope is wound around the second portions to form a loop, and is knotted. Alternatively, the rope may be not wound to form a loop, but rather be knotted at the two ends thereof. Alternatively, a single rope may be used to connect all the section portions. In other embodiments, several ropes may be used to connect sets of the second portions, wherein the number of each group of the second portions may be the same or different. Preferably, a single rope may be used to connect two corresponding second portions. Such connecting process is simple and easy to be performed manually, and the distance between the top sheet and the bottom sheet may be controlled flexibly, so that the height of various portions of the air mattress can be changed. For example, a portion of the air mattress corresponding to the user's head can be raised to act as a pillow. In another embodiment, the upper half of the air mattress may be raised, so that the air mattress acts as a tilt bed.

Now the first and second portions of the top and bottom connecting members 61 and 62 will be described in terms of relative positions thereof, with the air mattress in the substantially horizontal position. It should be noted that in this position, the second portions of the top and bottom connecting members 61 and 62 should not be construed as being offset from the corresponding first portions in the substantially horizontal direction. The second portions may be offset from the corresponding first portions in the vertical direction. For example, the strip may have a certain thickness, and include in the vertical direction the first portion secured to the inner surface and the second portion not secured to the inner surface formed, thereby allowing the connection of the intermediate connecting member 63 to the second portions. For example, the top and bottom members may be configured as a T-shaped structure, in which a horizontal part thereof comprises the first portion connected to the top and bottom sheets, and a vertical part thereof comprises the second portion. The intermediate connecting member extends between the second portions of the top and bottom connecting members.

Figure 8:
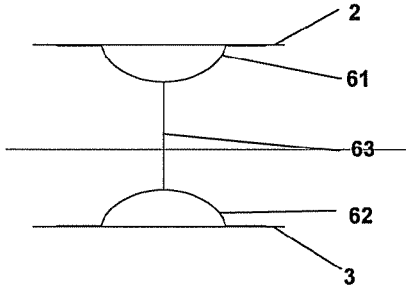
FIG. 8 shows top and bottom connecting members of another example of the air mattress of FIG. 5.

In the embodiment shown in FIG. 8, the top connecting member 61 and the bottom connecting member 62 may comprise respective top and bottom disks, which suck onto the inner surfaces of the top and bottom sheets 2 and 3 at the peripheral portions (acting as the first portions) thereof. The intermediate connecting member 63 is connected to the top and bottom disks at central portions (acting as the second portions) thereof. Similarly, the connecting length of the intermediate connecting member 63 may be changed to adjust the height of various portions of the air mattress.

Figure 9:
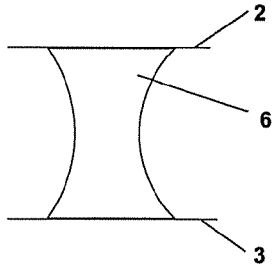
FIG. 9 shows a vertical connecting unit of another example of the air mattress of FIG. 5.

In another embodiment, the vertical connecting unit 6 may be one piece, and the upper and lower surfaces thereof are connected to the corresponding inner surfaces of the top and bottom sheets 2 and 3, as shown in FIG. 9. The vertical connecting unit 6 may comprise a molded component. Preferably, the molded component may be I-shaped.

Figure 10:
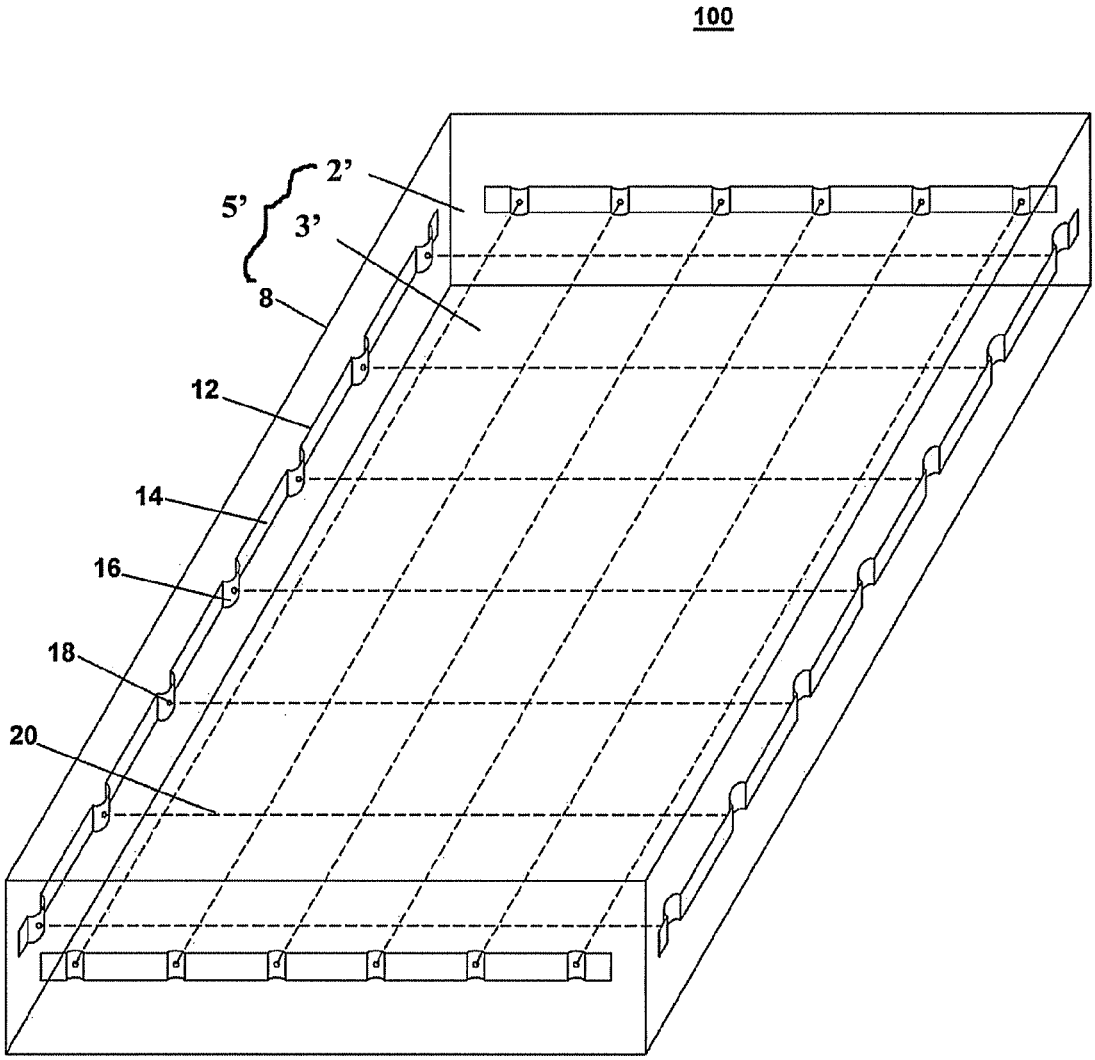
FIG. 10 is a perspective view of the air mattress of another embodiment according to the present invention.

FIGS. 10 to 14 show an air mattress 100 of another exemplary embodiment according to the present invention. FIG. 10 is a perspective view of the air mattress 100. The air mattress 100 may include a top sheet 2', a bottom sheet 3' and a side sheet 8, which sheets are connected to form an inflatable compartment 5' having a length, a width and a height. The inflatable compartment 5' may be also provided with means for feeding and discharging air (not shown). The top sheet 2' is substantially parallel to the bottom sheet 3'. When inflated, the inflatable compartment 5' acts as a bed for supporting the human body. As with the air mattress shown in FIGS. 5-9, within the inflatable compartment 5' may be provided a vertical connecting unit (not shown), which is connected to the top and bottom sheets to restrict relative vertical movement of the sheets. Within the inflatable compartment 5' may also be provided a horizontal connecting unit, which is connected to opposite portions of the side sheet 8 to restrict relative horizontal movement of the side sheet. As shown, the horizontal connecting unit may include horizontal strips 12 connected to opposite portions of the side sheet 8, and a flexible connecting member, for example a rope 20 (indicated by broken lines), connected between the opposite horizontal strips 12.

Figure 11:
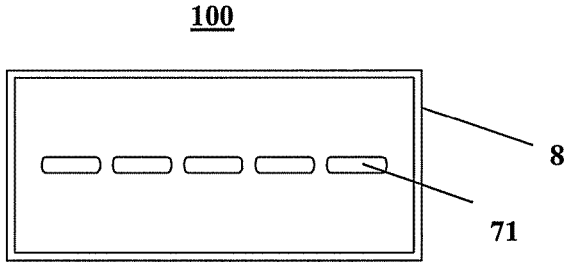
FIGS. 11(*a*), (*b*), (*c*) are a front view, a side view and a top view of the air mattress of FIG. 10, respectively.
Figure 11:
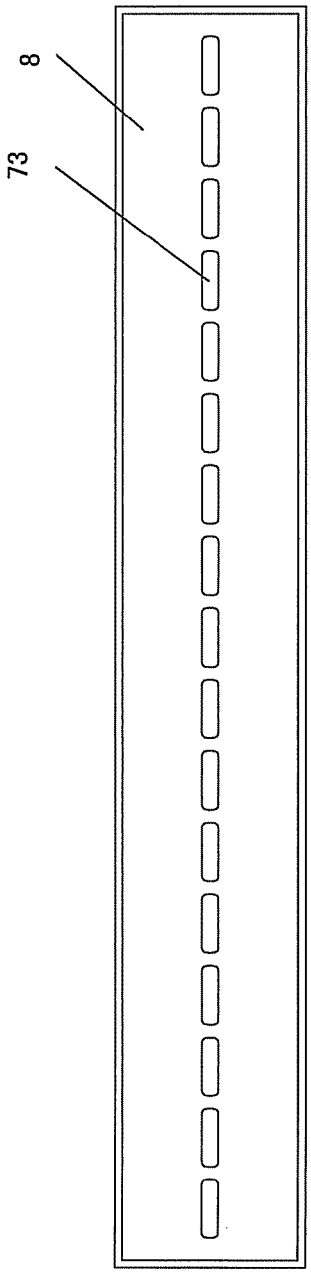
Figure 11:
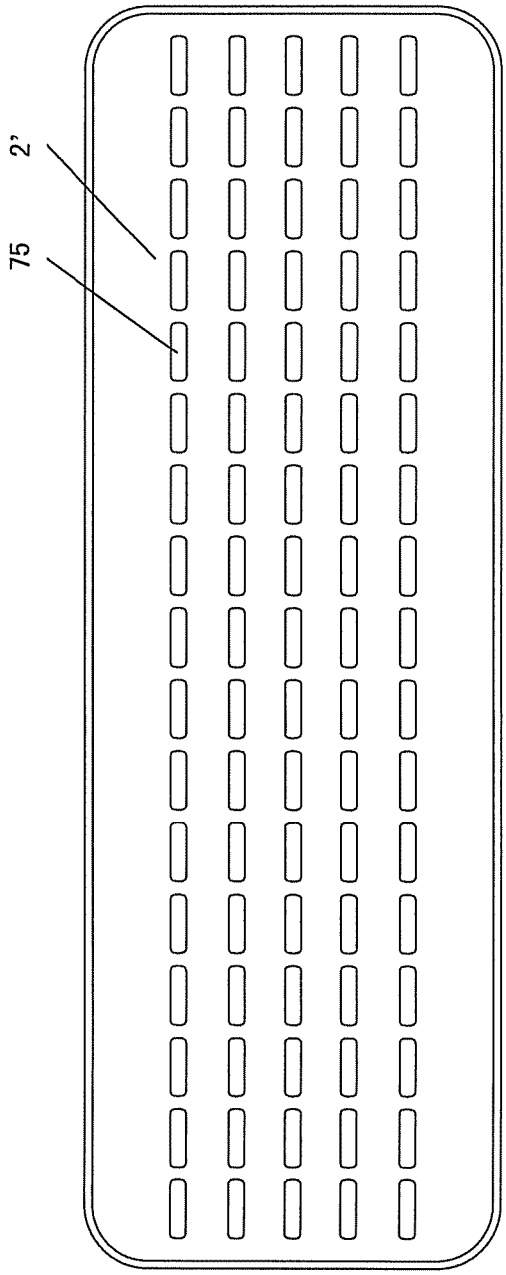

FIG. 11(*a*) is a front view of the air mattress 100, which shows that the connecting areas 71 formed by the connection of the side sheet 8 and the horizontal connecting unit extending horizontally in the length direction of the inflatable compartment. FIG. 11(*b*) is a side view of the air mattress 100, which shows that the connecting areas 73 formed by the connection of the side sheet 8 and the horizontal connecting unit extending horizontally in the width direction of the inflatable compartment. FIG. 11(*c*) is top view of the air mattress 100, which shows that the connecting areas 75 formed by the top sheet 2' and the vertical connecting unit extending vertically in the height direction of the inflatable compartment.

Referring back to FIG. 10, the horizontal strip 12 is a band of material with a length and a width, the length being greater than the width. The strip 12 may include a third portion 14 which is attached to the side sheet 8 and a fourth portion 16 which is not attached to the side sheet 8, the third portion 14 and the fourth portion 16 extending alternately in the length direction of the horizontal strip 12. The width of the horizontal strip 12 and the length of the third portion are not limited, provided that the requirement for connection strength is satisfied. The fourth portion 16 may be provided therein with a through-hole 18, through which the flexible rope 20 passes and then is knotted. As shown in FIG. 10, the ropes 20 extending in the length direction of the compartment are independent of the ropes 20 extending in the width direction thereof. In other words, these ropes are not cross connected. Alternatively, these ropes may be cross connected, i.e. knotted at a point. In this case, a woven web can be used to replace the knotted ropes, thereby improving the stability of the air mattress when inflated. The vertical connecting unit may have the same structure as the horizontal connecting unit.

Figure 12:
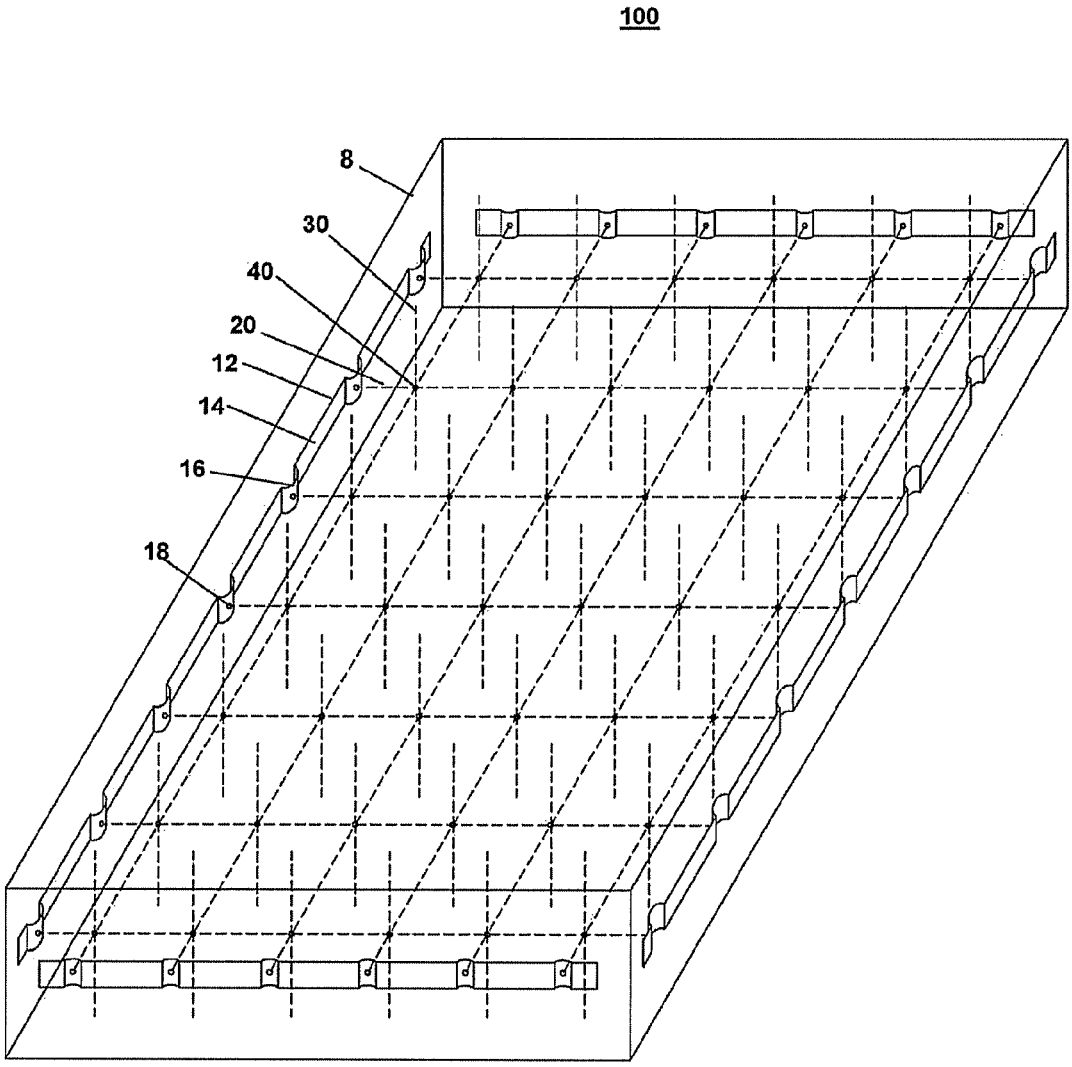
FIG. 12 is a perspective view of a variant of the air mattress of FIG. 10.
Figure 13:
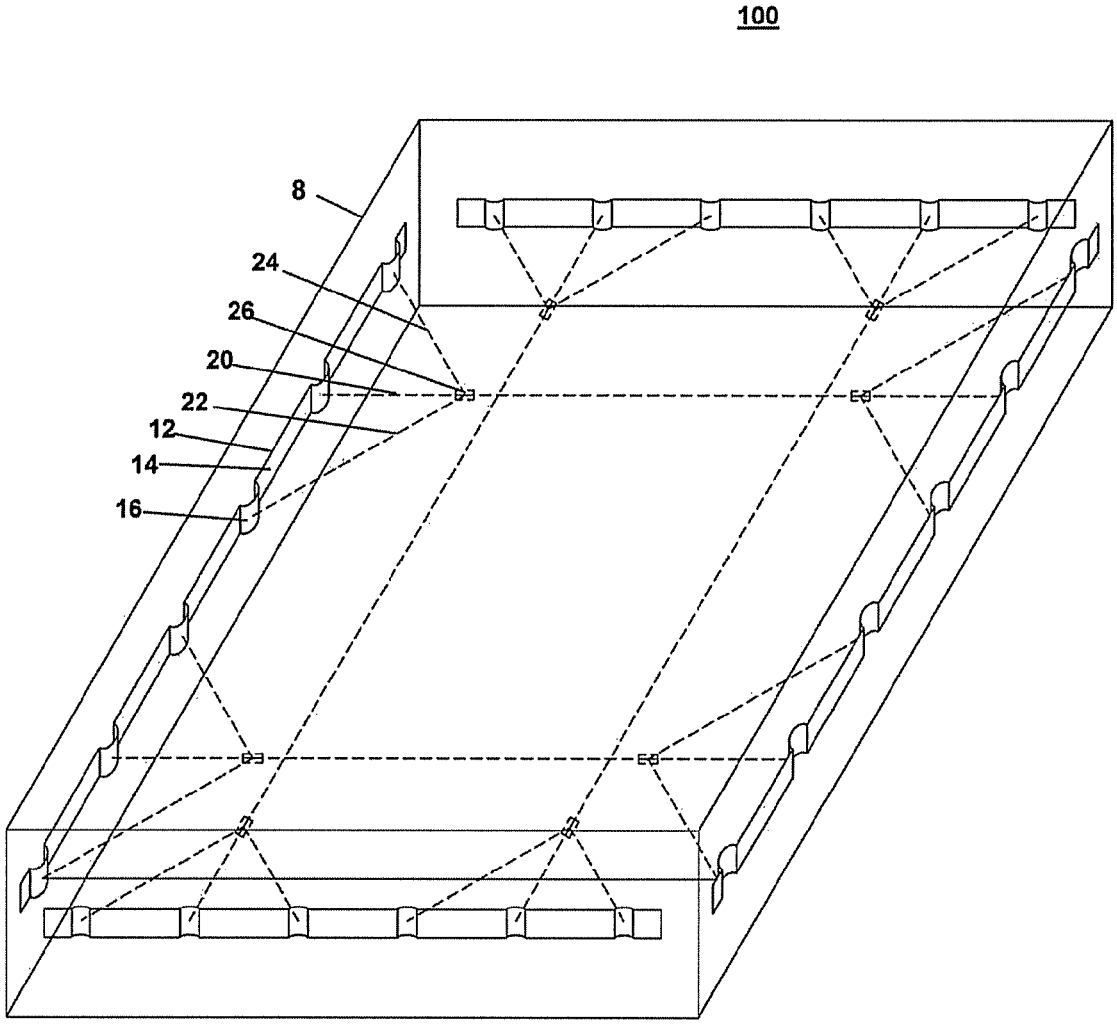
FIG. 13 is a perspective view of another variant of the air mattress of FIG. 10.

As shown in FIG. 12, the flexible ropes 30 of the vertical connecting unit may be connected to the flexible ropes 20 of the horizontal connecting unit at a point 40. In one variant, the flexible rope 20 extends entirely across the width of the compartment, and adjacent flexible ropes 22 and 24 are connected to the flexible rope 20 at one point 26, as shown in FIG. 13. It should be understood that in the variant shown in FIG. 13, the air mattress may include vertical connecting units, which may be constructed in the same manner as those in FIG. 12 or in other manners, such as in the same manner as the horizontal connecting unit in FIG. 13, i.e. the adjacent ropes being connected to one another at one point.

Figure 14:
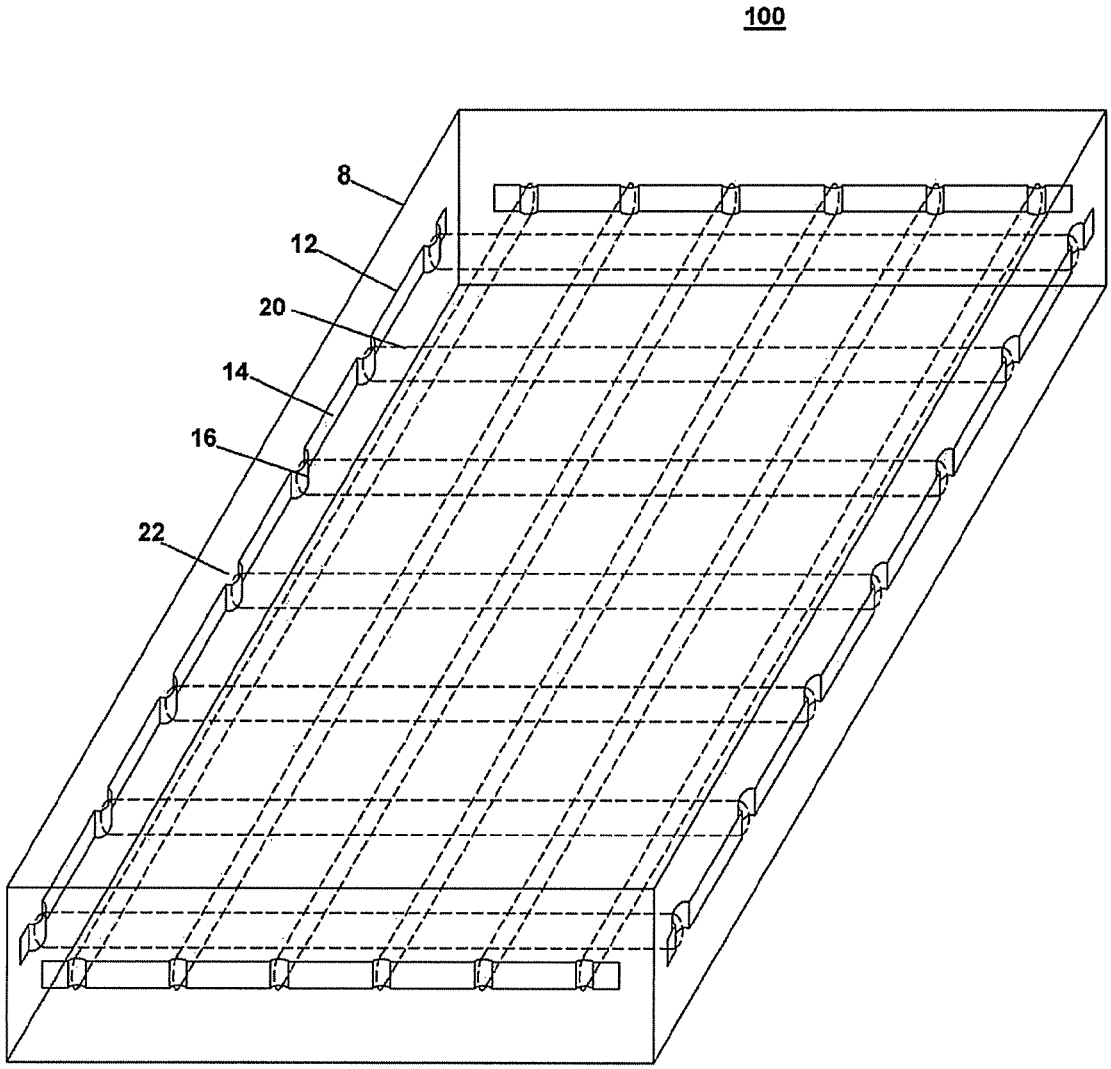
FIG. 14 is a perspective view of a further variant of the air mattress of FIG. 10.

As an alternative to the through-hole, the flexible rope 20 may be connected to the horizontal strip 12 in other manners. For example, as shown in FIG. 14, the fourth portion 16, the adjacent third portion 14, and the side sheet 8 form a enclosed ring 22, through which the flexible rope 20 passes and is knotted at two ends thereof, thereby forming a flexible rope loop.

Figure 15:
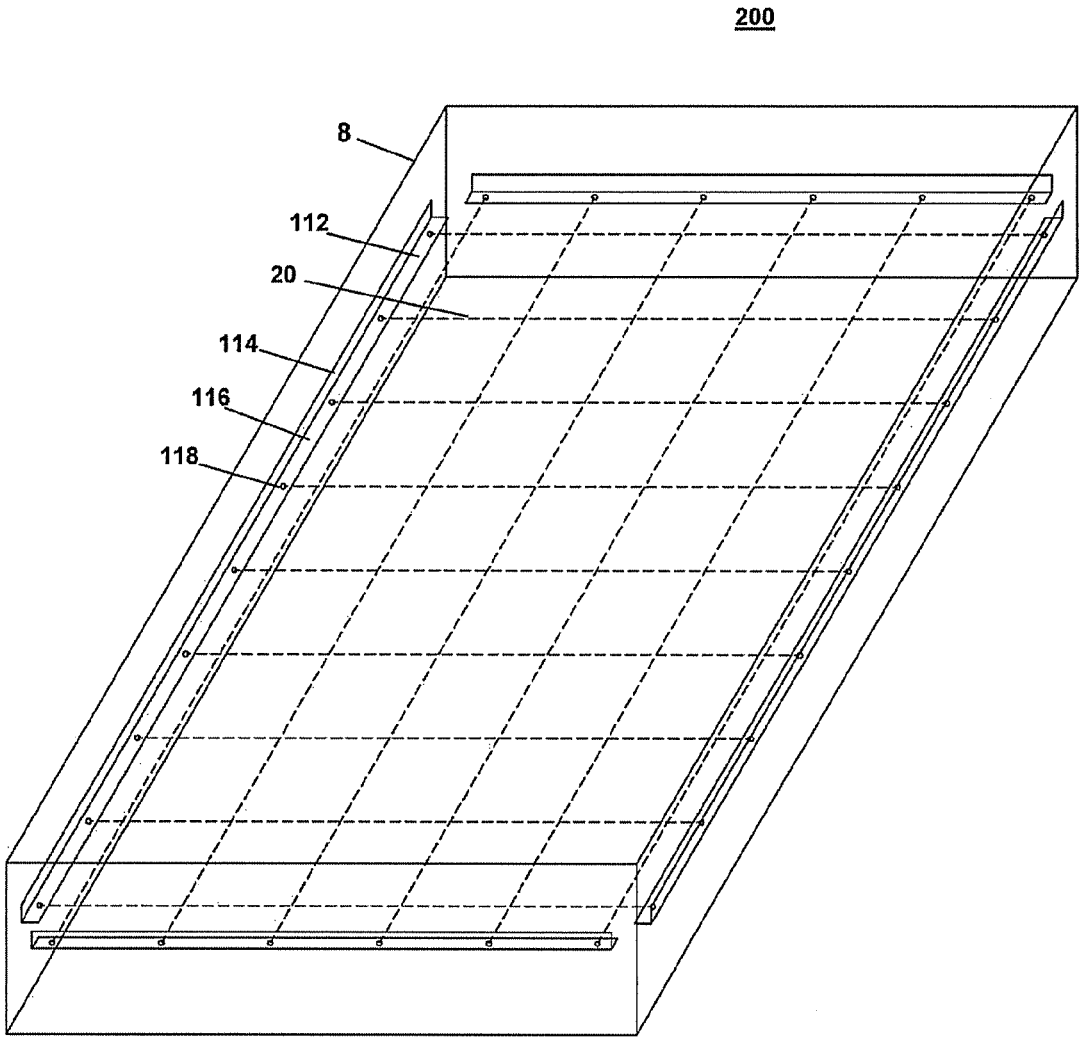
FIG. 15 is a perspective view of the air mattress of another embodiment according to the present invention.
Figure 16:
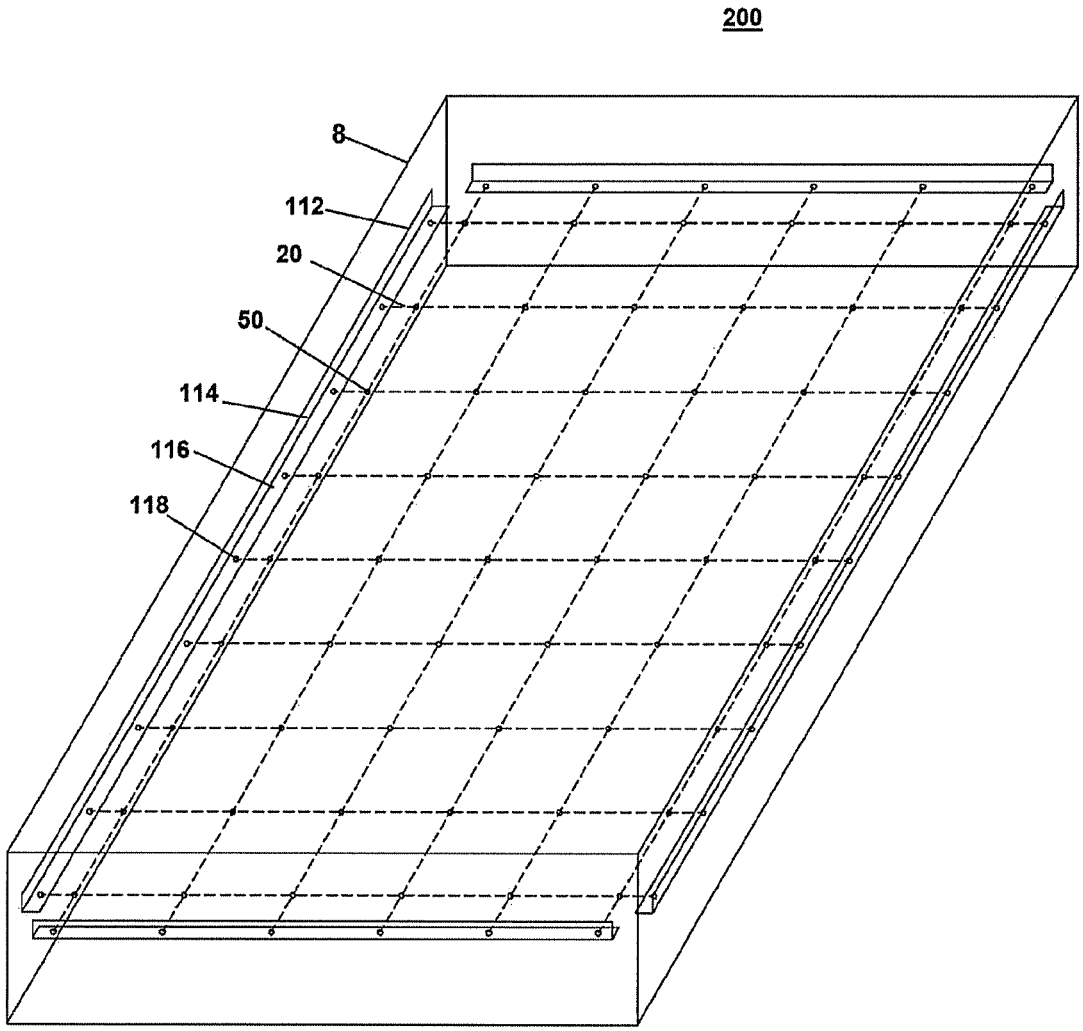
FIG. 16 is a perspective view of a variant of the air mattress of FIG. 15.

FIG. 15 is a perspective view of the air mattress 200 of another embodiment according to the present invention. The air mattress 200 of FIG. 15 is similar to the air mattress 100 of FIG. 10, except that the strips of the horizontal connecting units are different. Thus, similar components are indicated with like reference signs throughout these figures. Further, the description of the similar components is omitted for purpose of conciseness.

As shown, the horizontal strip 112 comprises a band of material having a length and a width, which includes along its width a third portion 114 which is attached to the side sheet 8 and a fourth portion 116 which is not attached to the side sheet 8. The width of the third portion 114 is not limited, provided that the requirement for connection strength is satisfied. The fourth portion 116 may be provided therein with a through-hole 118, through which the flexible rope 20 passes. The ropes 20 extending in the length direction of the compartment are independent of the ropes 20 extending in the width direction thereof. In other words, these ropes are not cross connected. Alternatively, these ropes may be cross connected at a point 50, for example by knotting. In this case, a woven web can be used to replace the knotted ropes, thereby improving the stability of the air mattress when inflated.

Figure 17:
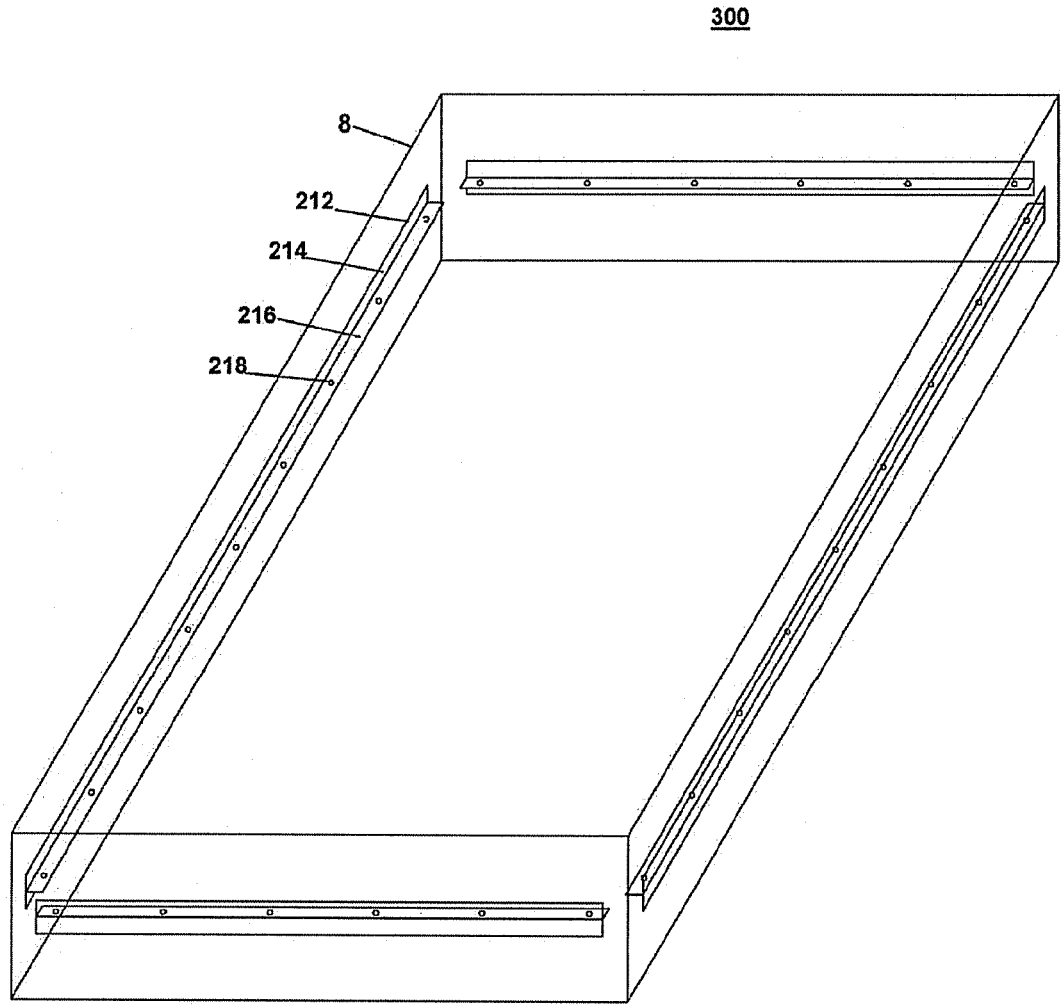
FIG. 17 is a perspective view of the air mattress of another embodiment according to the present invention.

FIG. 17 is a perspective view of the air mattress 300 of another embodiment according to the present invention. The air mattress 300 of FIG. 15 is similar to the air mattress 200 of FIG. 15 and the air mattress 100 of FIG. 10, except that the strips of the horizontal connecting units are different. Thus, similar components are indicated with like reference signs throughout these figures. Further, the description of the similar components is omitted for purpose of conciseness.

As shown, the horizontal strip 212 may be configured to be a structure having a "⊢"-shaped cross section, with a vertical part and a horizontal part. The vertical part constitutes a third portion 214 which is attached to the side sheet 8, and the horizontal part constitutes a fourth portion 216 which is not attached to the side sheet 8. The width of the third portion 214 is not limited, provided that the requirement for connection strength is satisfied. The fourth portion 216 may be provided therein with a through-hole 218, through which the flexible rope (not shown) passes. Although not shown, it is to be understood that the ropes extending in the length direction of the compartment are independent of the ropes extending in the width direction thereof. In other words, these ropes are not cross connected. Alternatively, these ropes may be cross connected, for example by knotting. In this case, a woven web can be used to replace the knotted ropes, thereby improving the stability of the air mattress when inflated.

Further, it is to be understood that although in the foregoing embodiments and variants, the flexible ropes 20 extending along the length and width of the compartment and the flexible ropes extending along the vertical direction include a plurality of ropes independent of each other, the invention is not limited to this. For example, a single rope may be used to pass through several or all of the fourth portions of the strips or through several or all of the through-holes in the fourth portions. Further, each rope may passes through the same or different number of the fourth portions or the through-holes.

The top sheet, the bottom sheet, the side sheet and the strips of the air mattress according to the invention may be made of PVC. Use of the above vertical and horizontal connecting members including flexible ropes reduces the amount of PVC, so that the weight of the product is decreased, thereby reducing the manufacture and shipping cost and improving the portability of the air mattress.

Further, the top sheet, the bottom sheet, the side sheet and the strips of the air mattress according to the invention may be made of TPU laminated stretch fabric, TPU laminated nylon, TPU laminated polyester, TPU laminated Oxford fabric, and TPU laminated with other fabric. Since the strips and these sheets are connected at connecting areas, thinner material sheet can be used to satisfy requirement for connecting strength. In an embodiment, a TPU film of the TPU laminated fabric may have a thickness of from 0.05 to 0.25 mm. Thus, the air mattress of the invention looks luxury, is environmentally friendly, lightweight, cold resistant, wear-resistant, flat, and portable, and has a high welding strength, and long lifetime, among other advantages.

The above embodiments are only illustrative of the present invention, not limiting to the scope of the invention which is defined by the appended claims. Further, it is to be understood that various modification and substitutions are possible without departing from the spirit of the present invention.

What is claimed is:

1. An air mattress, comprising:

a top sheet and a bottom sheet, the top and bottom sheets being made of a flexible airtight material and being hermetically connected to form an airtight inflatable compartment; and at least one vertical connecting unit, being disposed within the compartment, wherein the at least one vertical connecting unit is attached to respective inner surfaces of the top and bottom sheets to form connecting areas;

wherein each vertical connecting unit comprises:

a top connecting member and a bottom connecting member, each of said top and bottom connecting members having a first portion which is attached to the inner surface and a second portion which is not attached to the inner surface; and an intermediate connecting member, which is connected to the second portions of the top and bottom connecting members, wherein the top and bottom connecting members respectively comprise top and bottom strips, and the intermediate connecting member corn irises a flexible rope; and wherein each of the to and bottom strips an elongated band, the band including along its length a plurality of alternating first and second portions.

2. The air mattress of claim 1, wherein the flexible airtight material comprises Thermoplastic Urethane laminated fabric, which has a Thermoplastic Urethane film having a thickness of from 0.04 to 0.25 mm.

3. The air mattress of claim 1, wherein the top and bottom strips are made of Thermoplastic Urethane laminated polyester.

4. The air mattress of claim 1, wherein the connecting areas formed by the top and bottom strips and the top and bottom sheets are at least one of rectangular, rhombic, elliptic, and oval.

5. The air mattress of claim 1, further comprising:

a side sheet connected to the top and bottom sheets to form the compartment; and at least one horizontal connecting unit disposed within the compartment, said horizontal connecting unit connected to opposite portions of the side sheet so as to restrain the side sheet in the length and width of the compartment, wherein the horizontal connecting unit comprises horizontal strips which are attached to opposite portions of the side sheet, and a flexible connecting member, the horizontal strips each having a third portion which is attached to the side sheet to form connecting areas and a fourth portion which is not attached to the side sheet, the flexible connecting member connected to the opposite horizontal strips between corresponding fourth portions of the strips.

6. The air mattress of claim 5, wherein each of the horizontal strips comprises a band of a material, the band including along its length a plurality of alternating third and fourth portions, and the fourth portions are provided therein with through-holes, through which the flexible connecting member passes.

7. The air mattress of claim 5, wherein each of the horizontal strips comprises a band of a material, the band including along its length a plurality of alternating third and fourth portions, and the flexible connecting member passes through an enclosed loop formed by the fourth portion, the adjacent third portions and the side sheet.

8. The air mattress of claim 5, wherein each of the horizontal strips comprises a band of a material, the band including along its width the third and fourth portions, and the fourth portion is provided therein with through-holes, through which the flexible connecting member passes.

9. The air mattress of claim 5, wherein each of the horizontal strips is configured to be a structure having a "⊢"-shaped cross section, with a vertical part and a horizontal part, the vertical part constituting the third portion, the horizontal part constituting the fourth portion, and the fourth portion is provided therein with through-holes, through which the flexible connecting member passes.

10. The air mattress of claim 5, wherein the top sheet, the bottom sheet, the side sheet and the horizontal strips are made of Thermoplastic Urethane laminated fabrics, which has a Thermoplastic Urethane film having a thickness of from 0.05 to 0.25 mm.

11. The air mattress of claim 5, wherein the flexible connecting member extending along the length of the compartment is independent of the flexible connecting member extending along the width of the compartment.

12. The air mattress of claim 5, wherein the flexible connecting member extending along the length of the compartment is cross connected to the flexible connecting member extending along the width of the compartment.

13. The air mattress of claim 5, wherein the intermediate connecting member of the vertical connecting unit and the flexible connecting member of the horizontal connecting unit are connected with one another at a point.

* * * * *